United States Patent [19]

Tuneblom

[11] Patent Number: 4,697,850

[45] Date of Patent: Oct. 6, 1987

[54] CUTTER DRUM FOR PAVEMENT PROFILER

[75] Inventor: Eskil Tuneblom, Mount Arlington, N.J.

[73] Assignee: Dynapac Mfg. Inc., Stanhope, N.J.

[21] Appl. No.: 827,273

[22] Filed: Feb. 6, 1986

[51] Int. Cl.[4] ..... E21C 35/18

[52] U.S. Cl. ..... 299/87; 299/93; 299/91

[58] Field of Search ..... 299/39, 87, 88, 89, 299/91, 93; 404/90

[56] References Cited

U.S. PATENT DOCUMENTS

| | | | |
|---|---|---|---|
| 2,599,837 | 6/1952 | Joy | 299/91 |
| 4,268,089 | 5/1981 | Spence et al. | 299/91 X |
| 4,480,873 | 11/1984 | Latham | 299/39 X |
| 4,536,037 | 8/1985 | Rink | 299/91 X |
| 4,614,379 | 9/1986 | Wirtgen | 299/39 |

OTHER PUBLICATIONS

Two pages of Brochure entitled "RX-80 Dynaplane", Barber Greene, Release 101, p. 1952.
Brochure entitled "Roto-Mill, pr-275rt", CMI Corporation, 1979.
Four pages of Brochure entitled "Cold Planing", Cedarapids/Wirtgen, Bulletin CP-1.
Brochure entitled "Pavement Profiler, Dynapac PL2000".
Brochure entitled "Pavement Profiler, Dynapac PL1300".
Two flyers entitled "The Keyed Mandrel", Keystone, Indianapolis, Ind.
Booklet entitled "Carbide Tools", Kennametal, 1980, and supplements.
Kennametal promotional letter, Jan. 31, 1983, and attachments.
Asphalt Milling, Wirtgen, 1/77.
ER160 Roadcutter, Sakai Heavy-Industries, Ltd.
Roto-Mill Pavement Profiler, Caterpillar.
Dynaplane Cold Planer Cutting Technology, Barber Greene, p. 1914, Release 101 (4 pages).
Dynaplane Manual, p. 1910, Release 102 (2 pages).
Asphalt and Concrete Milling by Roconeco.
Roconeco 6.5 Sidewinder Pavement Profiler.
Roconeco 6.5 Sidewinder Specification Sheet.

*Primary Examiner*—Stephen J. Novosad
*Assistant Examiner*—Matthew Smith
*Attorney, Agent, or Firm*—Brumbaugh, Graves, Donohue & Raymond

[57] ABSTRACT

A cutter drum for pavement profiler machines has readily replaceable hardened tooth holders bolted to mounting bases. The teeth and holders function over extended periods of time without excessive wear. The tooth holder mounting bases, which have overlapping portions through which a bolt extends to hold the tooth holder in position, are formed of softer steel readily weldable to the cutter drum surface. Complementary surfaces on each of the tooth holders and an adjacent mounting base resist forces acting on the teeth during cutting operations.

6 Claims, 11 Drawing Figures

CUTTER DRUM FOR PAVEMENT PROFILER

BACKGROUND OF THE INVENTION

Pavement profiler machines use cutter drums to scarify, cut and profile concrete and asphalt pavements. The profiler machine includes a suitable machine chassis for mounting the drum and a motor to drive the drum above the surface to be profiled.

Cutting teeth are arranged on the drum in a spiral-like configuration to cut the pavement and to assist in picking up and transferring the cuttings to a conveyor. Holders are used to position the teeth and secure them to the drum. The holders are subjected to severe impact forces, and therefore are usually welded to flighting permanently secured to the drum.

The cutting teeth secured to the drum are subjected to high forces and friction, thereby requiring periodic replacement. The holders can also be subject to high friction and wear and require replacement, for example when a cutting tooth breaks off or becomes worn during drum operation. Because the holders need to be welded, unlike the teeth the holders cannot be made of a hardened material and therefore wear down quickly under such circumstances.

Known tooth holders are designed so that worn or broken teeth can readily be removed from the holder and replaced by new teeth. However, if the holder itself should become worn or damaged, replacement is more difficult and requires costly and time consuming welding in the field. Moreover, it is difficult to effect such welding precisely and accurately.

Several arrangements have been used for facilitating tooth holder replacement. Thus Dynapac's Pavement Profiler PL2000 uses a cutter drum having base segments bolted to the drum. Three tooth holders are welded to each segment. Tooth replacement is readily accomplished in the usual manner. Dynapac's bolted base segments provide advantages over tooth holders welded to flighting permanently secured to the drum. However, when replacement of a tooth holder is required, the entire base segment must be unbolted from the drum and the unit replaced.

Another manufacturer uses a cutter drum used for pavement profiling which incorporates a continuous flange on a drum, the flange incorporating pockets to receive a generally rectangular tooth holder bolted into the pocket. This construction fails to provide adequate support for the tooth holder, thus resulting in early wear and breakage of the block-like holders.

Still another manufacturer uses a cutter drum with flights carrying a number of welded-on tooth holders. Four bolts fasten the flights to mounting lugs welded to the drum.

Welding the tooth holders to the flights causes softening of the holder steel, thereby reducing wear resistance. Moreover, replacing broken tooth holders in the field by re-welding them to the flights involves special fixtures and requires time consuming welding work.

SUMMARY OF THE INVENTION

The present invention provides cutter drum apparatus for pavement profiler machines having readily replaceable hardened teeth and a novel tooth holder and mounting base arrangement that makes it possible to construct tooth holders of hardened material, e.g. hardened steel, to be more durable and which also permits worn or damaged tooth holders to be readily replaced on the drum. Thus the teeth and holders, the elements subjected to a high degree of wear during pavement profiling, can be formed of hardened steel and function over extended periods of time without excessive wear. The mounting bases for the tooth holders are formed of softer steel readily weldable to the cutter drum surface.

In a preferred embodiment of the invention, the mounting bases have overlapping portions through which a bolt extends to hold an associated tooth holder in position. An adjacent base is formed with a surface engaging a complementary surface on the tooth holder to resist forces generated by the cutting action of the tooth.

The invention will be better understood when reference is made to the following detailed description of a preferred embodiment taken in connection with the accompanying drawings.

DETAILED DESCRIPTION OF THE PREFERRED EMBODIMENT

Figure 1:
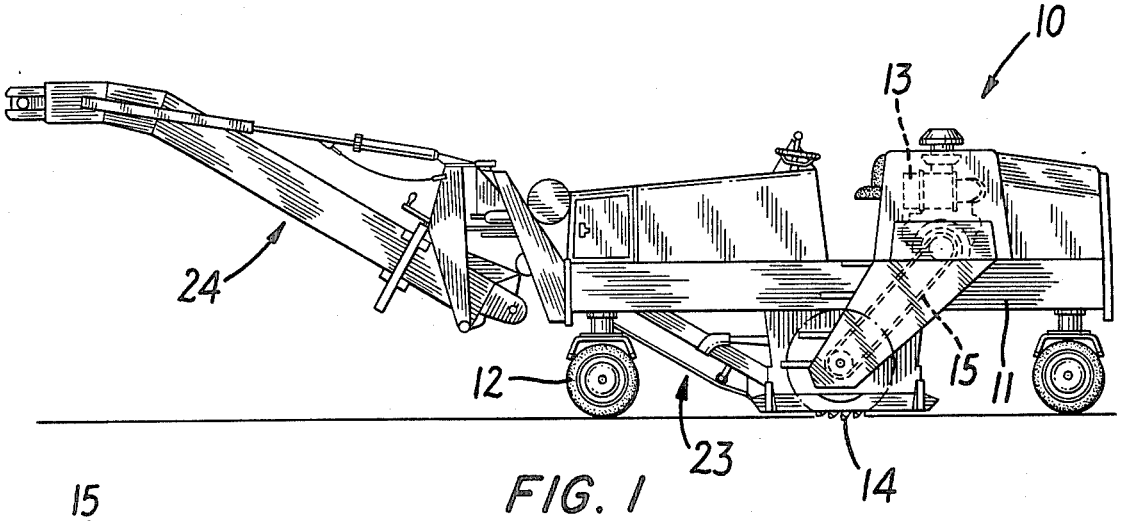
FIG. 1 is a side view of a pavement profiler embodying the cutter drum apparatus of the present invention.
Figure 2:
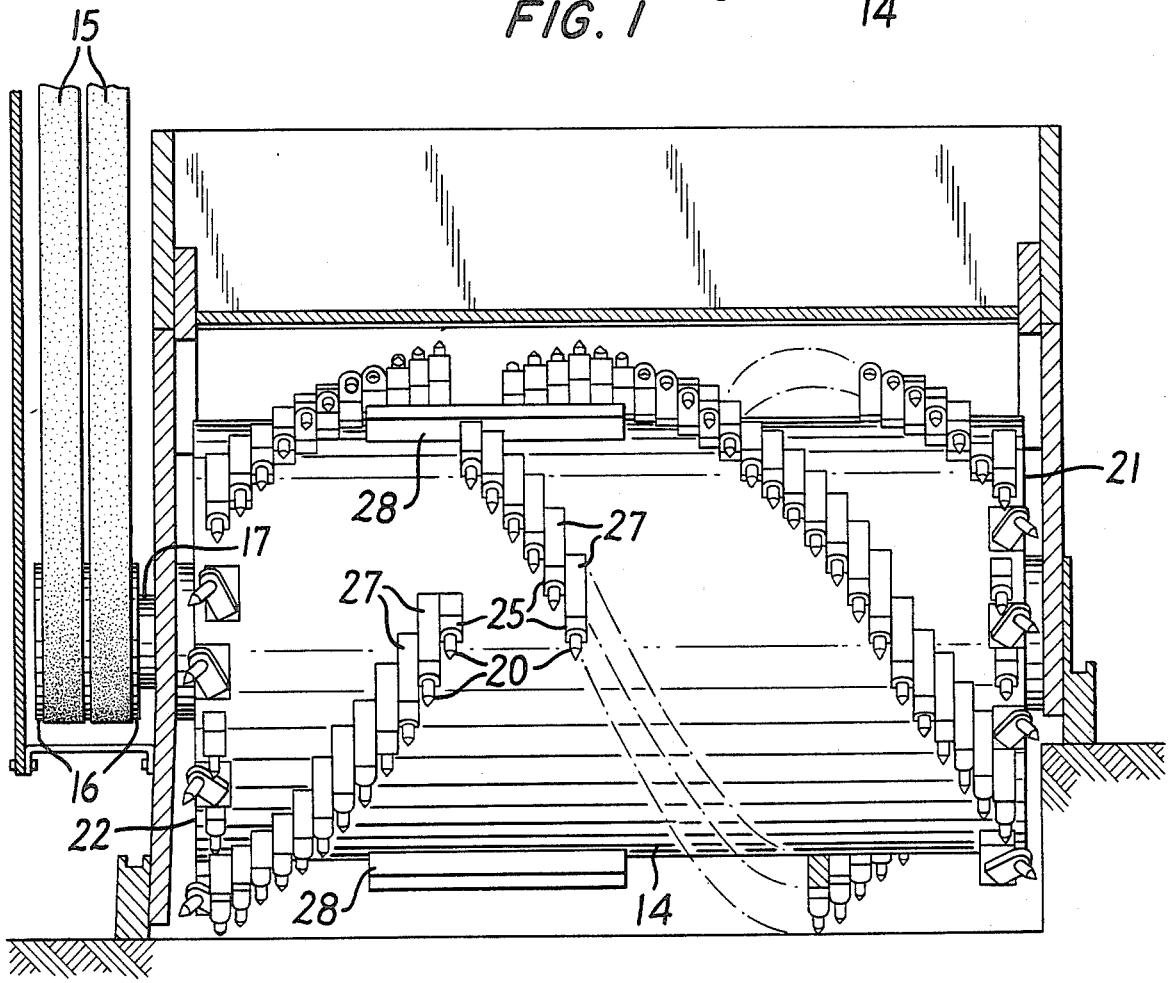
FIG. 2 is an enlarged front view of the cutter drum of FIG. 1 diagrammatically illustrating the cutting teeth configuration on the drum.

Referring to the invention in greater detail with particular reference to FIGS. 1 and 2, an exemplary pavement profiler 10 includes a chassis 11 mounted on wheels 12 or, if desired, on tracks, the latter being a well-known alternative. An engine 13 carried by the chassis drives, preferably through a clutch (not shown), a cutter drum 14 through a belt coupling 15. Pulleys 16 driven by the belts 15 are suitably connected to drive the cutter drum 14. While a shaft 17 is shown for illustrative purposes, the drive is usually through a planetary gear box or other appropriate arrangement, as described in U.S. Pat. No. 4,342,485 assigned to the assignee of the present application.

Hardened cutting teeth 20 are mounted by tooth holders 25, bolts 26 and mounting bases 27 (FIGS. 4 and 5), in a desired configuration on the surface of the cutter drum 14. Normally a spiral-type configuration is used with additional cutting teeth located along the edges of the curb side 21 and drive side 22 of the cutter drum 14. The cutting teeth 20 function to cut and profile concrete and asphaltic surfaces in a known manner. A conveyor, generally indicated at 23 and 24, serves to transport material cut from the pavement for discharge to a truck (not shown). Paddles 28 may be mounted on the drum to help sweep material onto the conveyor 23.

Figure 5:
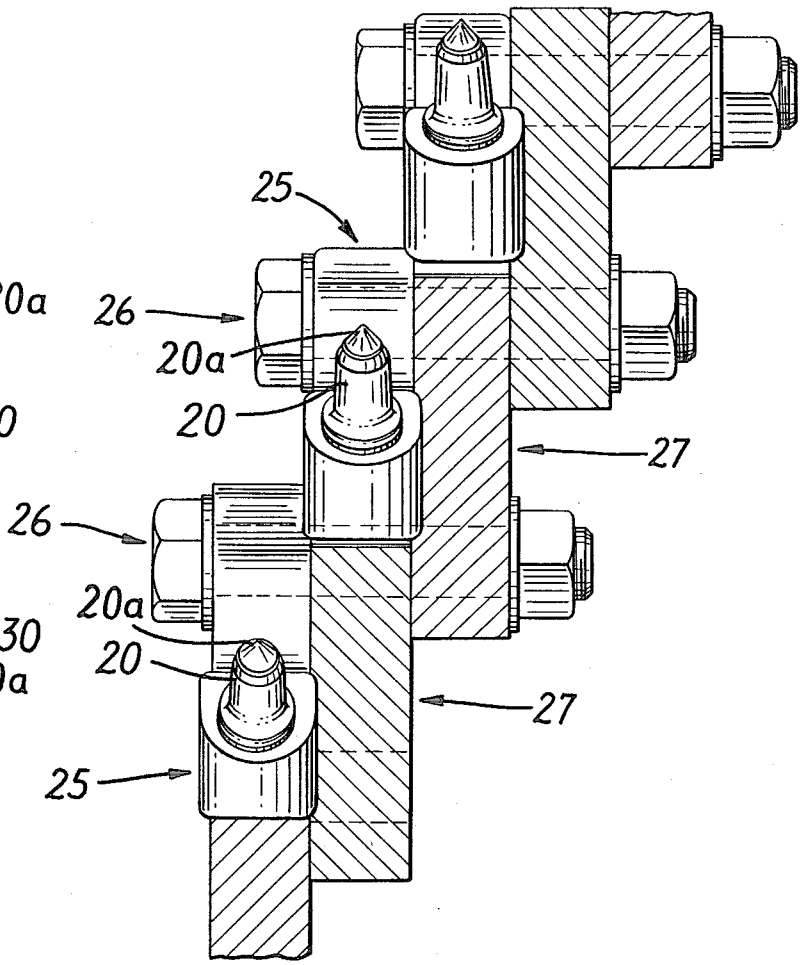
FIG. 5 is a plan view of the cutting teeth, tooth holders and mounting bases shown in FIG. 4.
Figure 4:
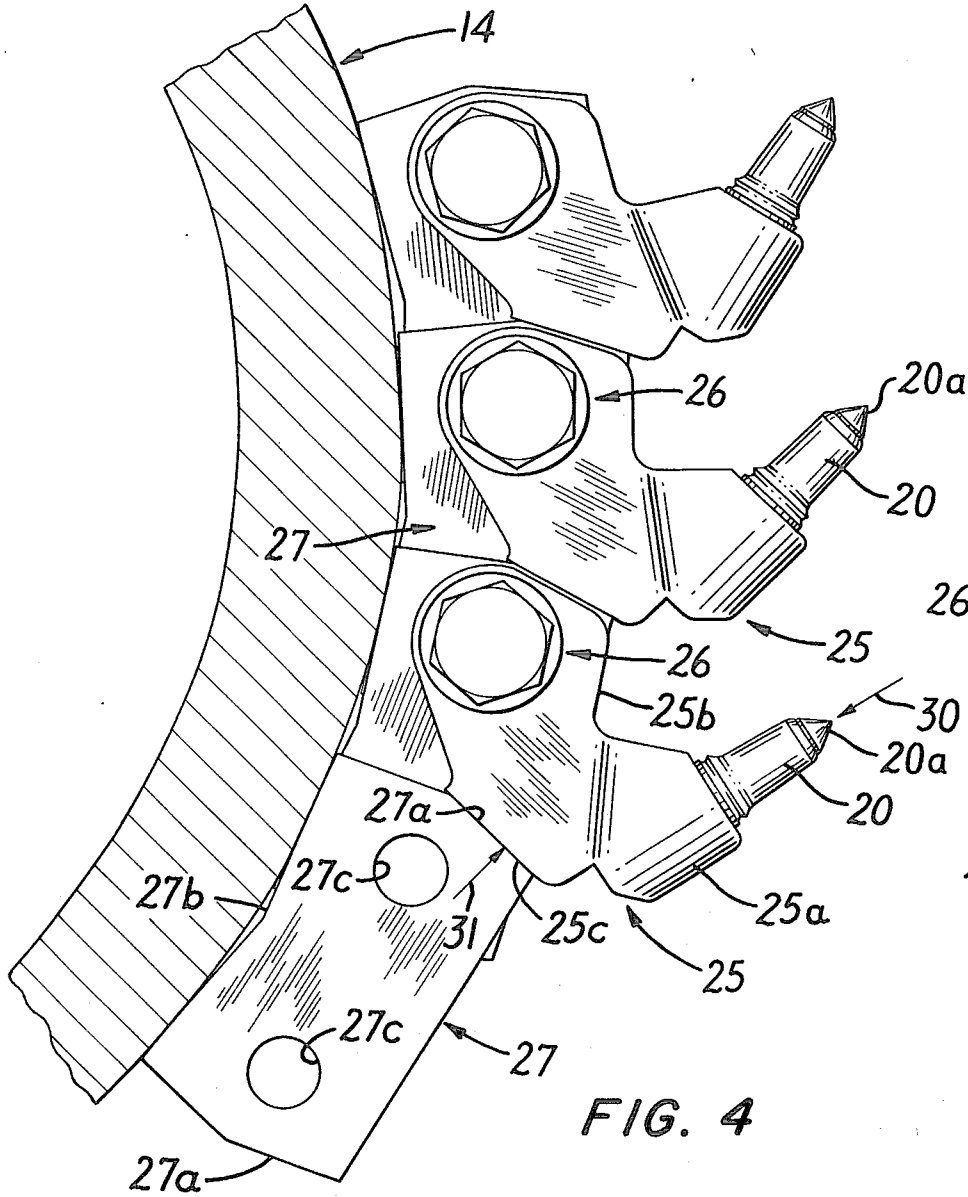
FIG. 4 is an enlarged side view of cutting teeth, tooth holders and mounting bases used on the cutter drum shown in FIGS. 1 and 2.

Examining the cutting tooth mounting system in greater detail, with particular reference to FIGS. 4 and 5, the cutting teeth 20 formed in a conventional manner of hardened steel and equipped with tungsten carbide tips 20*a* selected for the type of pavement being cut or profiled, are removably retained in the tooth holders 25 in a conventional manner. For example, leaf spring retainers can be used to hold the teeth in position. However, as soon as the teeth become worn or broken, they may readily be removed from the tooth holders 25 and replaced with new teeth.

Each of the tooth holders 25, formed of hardened steel, includes a tooth retaining section 25*a* and a mounting section 25*b* having an opening to receive the bolt 26. A surface 25*c* on the rear of the mounting section 25*b* is complementary to and engages a suitably oriented surface 27*a* on the mounting base 27.

The mounting bases 27 are formed of a steel readily weldable to the surface of the drum 14. A lower surface 27*b* is suitably configured to follow approximately the curvature of the drum surface. As shown, the surface 27*b* provides two areas for welding the mounting base to the surface of the drum.

Also provided in the mounting base 27 are a pair of openings 27*c* for receiving the bolts 26. Finally, each end of the mounting base 27 is cut at an angle to provide the complementary bearing surface 27*a* for engaging the surface 25*c* of an adjacent tooth holder 25. With both ends having surfaces 27*a*, the bases can be oriented in any desired direction.

Figure 3:
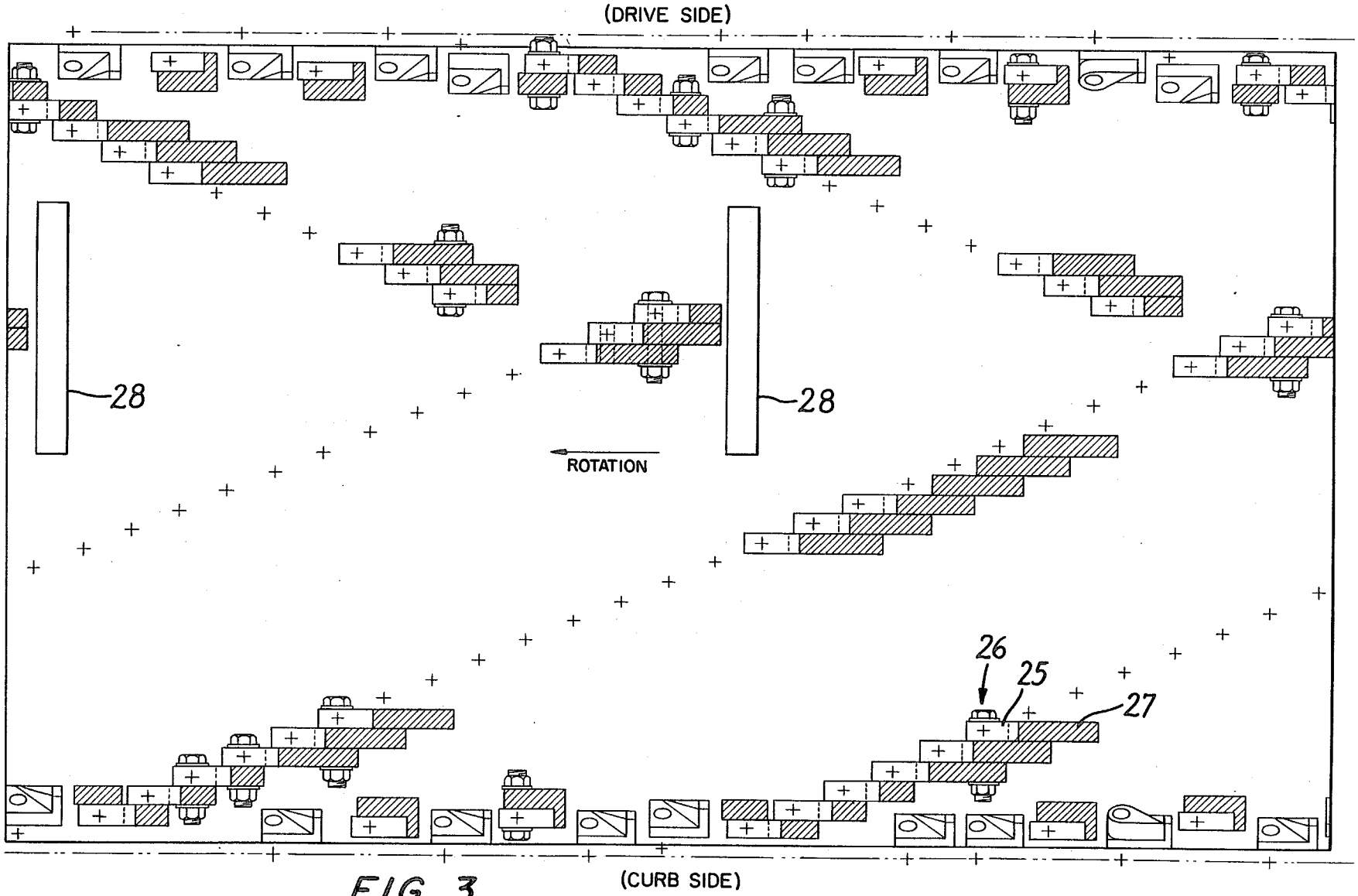
FIG. 3 is a plan view development of the drum surface of FIG. 2 illustrating the location of elements forming the tooth cutter system.

To assemble the cutting teeth elements on the drum 14, the mounting bases 27 are welded to the drum in a spiral-like configuration, shown diagrammatically in the development view (a flattened view of the drum surface) of FIG. 3. Note that only some of the bases are shown, with each base 27 overlapping an adjacent base 27. The locations of the bases are governed by the position of the plus marks which denote teeth. Some of the tooth holders 25 are also indicated diagrammatically with the plus marks again denoting teeth locations. Some bolts 26 are also shown holding the tooth holders to the mounting bases.

After the mounting bases, formed of a weldable steel, have been securely welded to the cutter drum 14 in the desired spiral-like configuration, the tooth holders are secured by the bolts 26 which pass through the opening in each of the tooth holders and through two openings 27*c* in two overlapping mounting bases 27. With the tooth holder secured in position by the bolt 26, cutting forces generated upon rotation of the drum 14 will act on the tooth 20 as shown by the arrow 30. Opposing the forces 30 will be an oppositely directed forces denoted by the arrow 31, provided by the complementary surfaces 27*a* and 25*c*. Note that any forces on the bolt 26 resulting from cutting action of the tooth 20 will be distributed by the bolt 26 to two of the mounting bases 27.

The tooth holders 25, as well as the teeth 20, are formed of a hardened steel selected to resist wear and breakage under the heavy duty pavement cutting operation. It is possible to use hardened steel with all of the attendant wear advantages since the tooth holders are bolted, not welded, individually to overlapping mounting bases formed of weldable material. Thus the elements exposed to extreme wear, the cutting teeth 30 and the tooth holders 25, can be used for pavement profiling for an extended period of time. Yet replacement of a tooth 20 or a tooth holder 25 is a simple matter. The tooth is replaced in the conventional way. The tooth holder 25 is replaced by removing the bolt 26 and then bolting another tooth holder into position.

Figure 10:
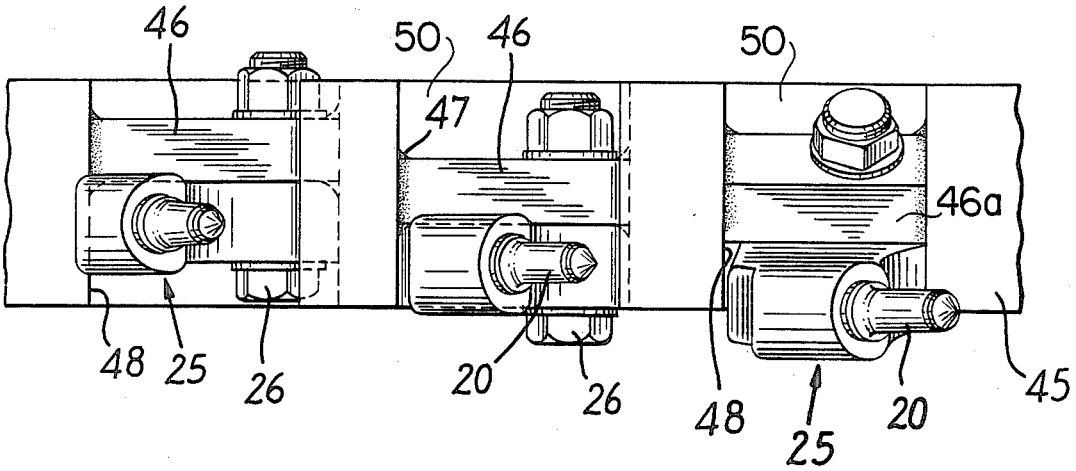
FIG. 10 is a plan view of another embodiment of an arrangement of cutting teeth, tooth holders, and a mounting base segment that may be used on the drive side or curb side of the cutter drum.
Figure 11:
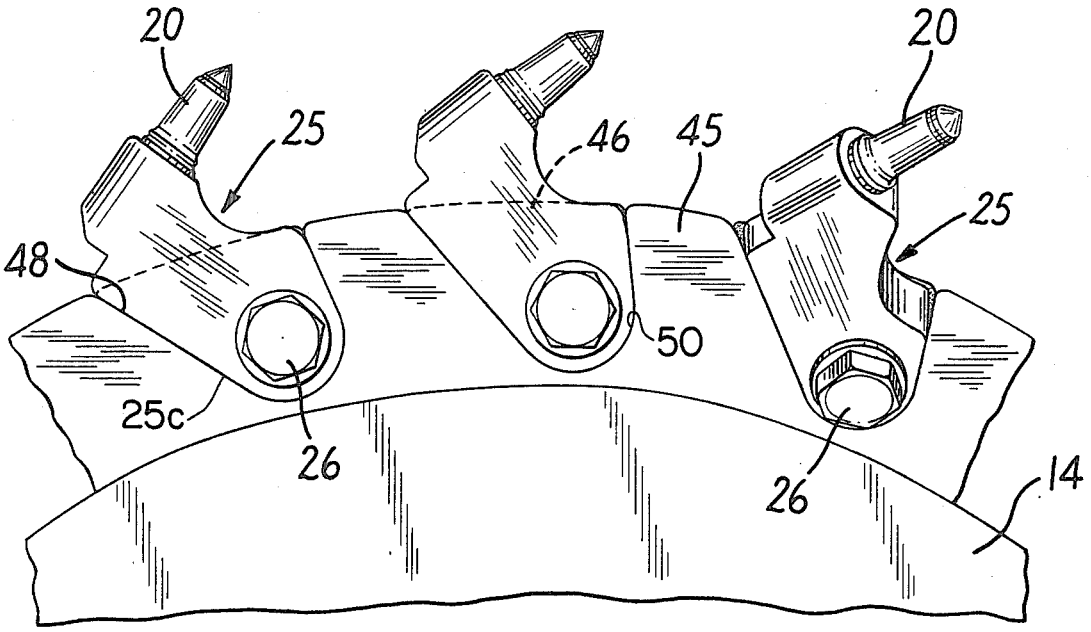
FIG. 11 is a side view of the arrangement shown in FIG. 10, mounted on the drum.

A special cutting tooth configuration is used at the curb side 21 and the drive side 22 of the drum 14. A first embodiment of an edge cutter configuration is shown in FIGS. 2–3 and 6–9. A second embodiment of an edge cutter configuration is shown in FIGS. 10–11. Both embodiments employ the same tooth holder, 25. The purpose of these special cutting tooth configurations is to provide a clean cut along the edges of the strip of pavement being profiled by the cutter drum 14.

Figure 6:
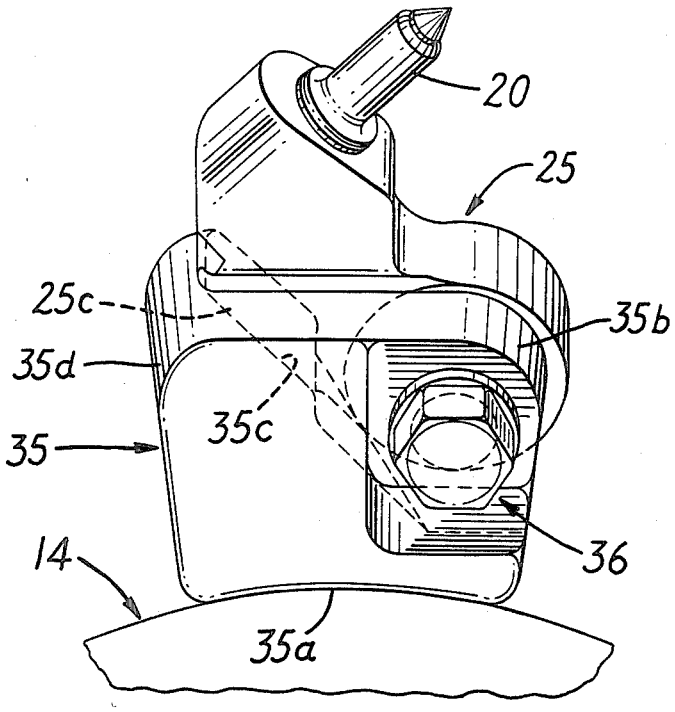
FIG. 6 is a side view showing one embodiment of a cutting tooth, tooth holder and mounting base used on the drive side of the drum.
Figure 7:
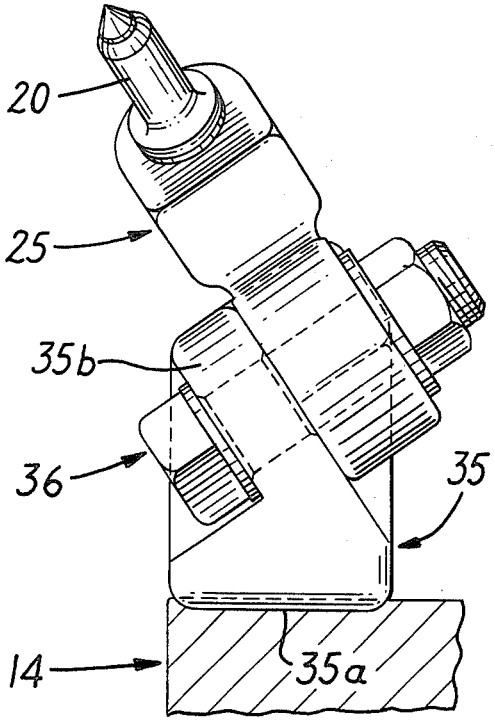
FIG. 7 is a front view of the cutting tooth, tooth holder and mounting base shown in FIG. 6.
Figure 8:
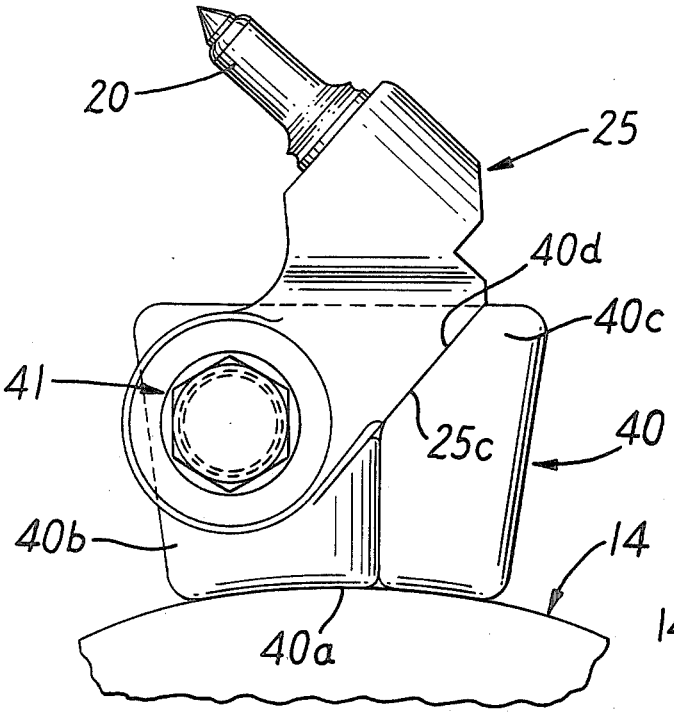
FIG. 8 is a side view of one embodiment of a cutting tooth, tooth holder and mounting base used on the curb side of the cutter drum.
Figure 9:
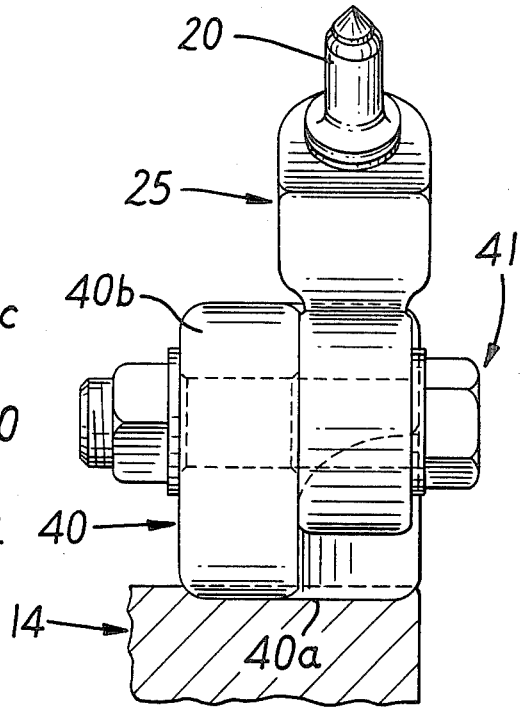
FIG. 9 is a front view of the cutting tooth, tooth holder and mounting base shown in FIG. 8.

FIGS. 6 and 7 show one of the cutting tooth assemblies used on the drive side and FIGS. 8 and 9 a cutting tooth assembly used on the curb side of the first embodiment. Mirror images of all of these cutting tooth assemblies are also found on the drive and curb sides, as indicated in FIG. 2.

Referring to FIGS. 6 and 7, a mounting base 35 is formed of weldable steel to facilitate weldment to the drum 14 along a surface 35*a*. An angled flange portion 35*b* extends upwardly and outwardly from the mounting surface 35*a* and includes an opening receiving a bolt 36. One of the tooth holders 25 is bolted to the mounting base 35 with the tooth holders surface 25*c* bearing against a complementary angled surface 35*c* of an upstanding portion 35*d* of the mounting base. With this structure, forces exerted on the cutting tooth 20 will be transmitted to the complementary surfaces, 25*c* and 35*c*.

Referring to FIGS. 8 and 9, a mounting base 40 formed of weldable steel is provided with a surface 40*a* contoured to engage the surface of the drum 14 for weldment thereto. A flange portion 40*b* includes an opening to receive a bolt 41. A rear section 40*c* includes a surface 40*d* engaging the complementary surface 25*c* of the tooth 25 mounted on the base 40 by the bolt 41.

As explained in connection with the mounting base 27, the drive side and curb side cutting tooth assemblies facilitate field replacement of the tooth holders 25. Moreover, these parts, subject to wear during pavement profiling, can be readily replaced while the mounting bases 35 and 40, made of softer steel to enable their weldment to the drum 14, are not subject to the high degree of wear of the holders.

FIGS. 10–11 show an alternative embodiment of an edge cutter profile. An arcuate base segment 45, capable of carrying plural tooth holders, is welded along the outside or inside edge (curb or drive side) of the cutter drum 14, in place of the individual curb side or drive side bases, e.g. 35, 40 shown in FIGS. 2 and 3. Each base segment 45 has a plurality of transverse cutout sections, each defining an arcuate well portion 50 and a back support surface 48 oriented at an angle to the drum radius.

A support plate 46 is positioned in each well portion 50 and welded to the front and back surfaces of the well 50 as shown by 47. Each plate 46 has a flat side surface with a hole for receiving a bolt 26, and as shown in FIG. 10 a tooth holder 25 is positioned in the well 50 and bolted to the plate 46 with each tooth 20 generally projecting in one direction from one side of its associate tooth holder. With this arrangement, forces acting on each tooth 20 are resisted by the complementary engaging surfaces 25*c* and 48 (FIG. 11) at the other side of the holder 25 opposite to the one side from which the tooth projects.

The plate 46 can be welded at various widthwise positions to vary the lateral spacing of the tooth 20. Also, a plate 46*a* has been rotated about a horizontal angle so that the tooth 20 projects at an angle to the vertical plane. Any orientation can be selected for the plate 46 relative to the well 50, i.e. both the vertical angle and the horizontal angle can be varied, to change the angle of projection of the tooth.

In the configuration in FIG. 3, there is a set of six edge teeth between each helix. With this embodiment of FIGS. 10–11, a base segment may be provided with six cut-outs for tooth holders to replace each set. If desired, more than one segment can be used. Also, the tooth orientations may be the same as in FIGS. 2–3 and 6–9 or may be any other desired configuration, by welding the plates 46, 46*a* at the appropriate angles in the wells 50, to provide a desired tooth profile along the curb and drive sides.

Each tooth holder is bolted, by bolts 26, to a support plate 46, 46*a*, and is supported against the back support surface 48 as shown. As noted before, the present invention permits the same tooth holders to be used for both the edge profile and the helical tooth profile. Also, mirror image base segments may be used for the curb side and drive side edges.

The use of a single tooth holder 25 made of hardened steel and which is adapted to receive a desired form of cutting tooth 20, depending upon the pavement to be cut, minimizes inventory problems and enables ready field replacement of worn and broken tooth holders and teeth. There is no need for welding holders to the drum in the field, or welding holders to flights, a process that often resulted in less than perfect weldments and erroneous alignment of holders and cutting teeth.

I claim:

1. A cutter drum for a pavement profiler comprising a drum, mounting bases welded to the drum surface in a selected spiral-like configuration with a portion of one base overlapping a portion of an adjacent base, tooth holders associated with the mounting bases, a cutting tooth removably held by each tooth holder, a bolt extending through the overlapping base portions and one of the associated tooth holders to secure the holder to the bases, complementary and engaging surfaces on each of the tooth holders and an adjacent one of the bases, the complementary and engaging surfaces being located on the side of the tooth holder opposite to the tooth so that the forces acting on the tooth during cutting operations are resisted by the adjacent base.

2. A cutter drum as defined in claim 1, in which the tooth holders are formed of hardened steel and the mounting bases are formed of readily weldable steel.

3. A cutter drum for a pavement profiler comprising a drum, first mounting bases welded to the drum surface in a selected spiral-like configuration with a portion of one base overlapping a portion of an adjacent base, tooth holders associated with the first mounting bases, a cutting tooth removably held by each tooth holder, a bolt extending through the overlapping base portions and one of the associated tooth holders to secure the holder to the first bases, first complementary and engaging surfaces on each of the tooth holders and an adjacent one of the first bases, the first complementary and engaging surfaces being located on the side of the tooth holder opposite to the tooth so that the forces acting on the tooth during cutting operations are resisted by the adjacent base, curb side and drive side mounting bases welded to curb and drive side edges of the drum surface, a tooth and tooth holder associated with each curb side and drive side mounting base, a bolt extending through each of the curb side and drive side bases to secure one of the tooth holders to each said base, second complementary and engaging surfaces on each curb side and drive side tooth holder and its associated base, the second complementary surfaces located on the side of the tooth holder opposite to the tooth so that the forces acting on the tooth during cutting operations are resisted by the associated base, wherein said curb side and drive side mounting bases, and therefore said associated teeth, are oriented in a selected configuration to provide clean cuts along the edges of pavement strips.

4. A cutter drum as defined in claim 3, in which the tooth holders are formed of hardened steel, and the curb side mounting bases, the drive side mounting bases, and the first mounting bases employ interchangeable tooth holders and are formed of readily weldable steel.

5. A cutter drum for a pavement profiler comprising a drum, first mounting bases welded to the drum surface in a selected spiral-like configuration with a portion of one base overlapping a portion of an adjacent base, tooth holders associated with the first mounting bases, a cutting tooth removably held by each tooth holder, a bolt extending through the overlapping base portions and one of the associated tooth holders to secure the tooth holder to the first bases, first complementary and engaging surfaces on each of the tooth holders and an adjacent one of the first bases, the first complementary and engaging surfaces being located on the side of the tooth holder opposite to the tooth so that the forces acting on the tooth during cutting operations are resisted by the adjacent base, curb side and drive side base segments welded to curb side and drive side edges of the drum surface, each base segment including a plurality of transverse cut-outs, a support plate welded in each cut-out, a tooth and tooth holder positioned in each cut-out and bolted to the support plate, second complementary and engaging surfaces on each curb side and drive side tooth holder and its associated cut-out, the second complementary surfaces located on the side of the tooth holder opposite to the tooth so that the forces acting on the tooth during cutting operations are resisted by the associated base segment, at least some of the support plates being welded at different angles to the drum surface, and therefore the teeth are oriented in a selected configuration to provide clean cuts along the edges of pavement strips.

6. A cutter drum for a pavement profiler including a drum having a curb side and a drive side, cutting teeth mounted on said drum in a selected configuration between said curb side and drive side, and a curb side and a drive side cutting arrangement, said arrangement comprising curb side and drive side base segments welded to curb side and drive side edges of the drum surface, each base segment including a plurality of transverse cut-outs, a support plate welded in each cut-out in a selected orientation to the base segment to provide a desired tooth profile along the curb and drive sides, a tooth and tooth holder positioned in each cut-out and bolted to the support plate, each tooth projecting generally in one direction from one side of the tooth holder, each cut-out having a complementary surface associated with its tooth holder, a complementary surface on each tooth holder located on the side of the tooth holder opposite to the direction of tooth projection and engaging the complementary cut-out surface so that the forces acting on the tooth during cutting operations are resisted by the complementary engaging surfaces and hence the associated base segment, at least some of the support plates being welded at different angles to the drum surface, and therefore the teeth are oriented in a selected configuration to provide clean cuts along the edges of pavement strips.

* * * * *